United States Patent [19]

Jones

[11] Patent Number: 4,697,425

[45] Date of Patent: Oct. 6, 1987

[54] OXYGEN CHEMISORPTION CRYOGENIC REFRIGERATOR

[75] Inventor: Jack A. Jones, Los Angeles, Calif.

[73] Assignee: The United States of America as represented by the Administrator of the National Aeronautics and Space Administration, Washington, D.C.

[21] Appl. No.: 855,982

[22] Filed: Apr. 24, 1986

[51] Int. Cl.[4] ..... F17C 11/00

[52] U.S. Cl. ..... 62/48; 62/467; 62/514 R

[58] Field of Search ..... 62/48, 514 R, 467

[56] References Cited

U.S. PATENT DOCUMENTS

| | | | |
|---|---|---|---|
| 3,854,301 | 12/1974 | Cytryn | 62/101 |
| 4,111,002 | 9/1978 | Van Mal et al. | 62/514 R |
| 4,183,227 | 1/1980 | Bouvin | 62/480 |
| 4,346,563 | 8/1982 | Hood | 62/117 |
| 4,366,680 | 1/1983 | Tward | 62/514 R |
| 4,643,000 | 2/1987 | Rheinfelder | 62/467 |

*Primary Examiner*—Ronald C. Capossela

*Attorney, Agent, or Firm*—Paul F. McCaul; John R. Manning; Thomas H. Jones

[57] ABSTRACT

A chemisorption refrigeration system includes dual containers containing a material such as silver which is alternately heated and cooled to chemically desorb and reabsorb oxygen gas. The gas is desorbed at high temperature and pressure and is pre-cooled and then passed through a Joule-Thomson valve where it is expanded and partially liquefied to provide cooling at 60°-100° K. The liquefied oxygen is then boiled and returned to a cooled container where it is reabsorbed. By alternately heating and cooling the containers, a continuous source of high pressure high temperature oxygen can be provided.

15 Claims, 1 Drawing Figure

OXYGEN CHEMISORPTION CRYOGENIC REFRIGERATOR

BACKGROUND OF THE INVENTION

1. Origin of the Invention

The invention described herein was made in the performance of work under a NASA contract, and is subject to the provisions of Public Law 96-517 (35 USC 202) in which the Contractor has elected not to retain title.

2. Field of the Invention

This invention relates to cryogenic refrigeration systems with minimal moving parts for use in aerospace applications such as the cooling of infrared sensors. Mechanical refrigeration systems are unsuited for aerospace long-term operation not only due to servicing difficulties and limited lifetime, but more importantly because the compressors and related components introduce vibration into the system.

3. Description of the Prior Art

Refrigeration systems employing non-mechanical compressors have been developed in the past. One type of system employs a charcoal/nitrogen physical adsorption system in which nitrogen is physically adsorbed onto charcoal and then heated to release high pressure nitrogen which is subsequently reduced in pressure to lower the temperature to provide refrigeration. Such systems have not found wide use due to very inefficient operation. Typically, about 200 watts of heat per watt of cooling may be required in such a system.

Hydride chemical absorption (chemisorption) cryogenic refrigeration systems have also been developed. Such systems make use of well-known reversible chemical reactions between hydrogen and various materials. Upon cooling of the material, hydrogen is chemically absorbed. When heated, the hydrogen gas is released at a high temperature and high pressure. The high pressure gas is then passed through a Joule-Thomson expansion valve to reduce the pressure and temperature of the gas.

A major drawback of hydride refrigeration systems is that their operating temperatures are extremely low and the hydrogen gas must be pre-cooled prior to being applied to the expansion valve. Above certain temperatures, expanding the hydrogen gas will actually cause it to increase in temperature rather than decrease. The necessary pre-cooling may be accomplished by the addition of a mechanical refrigeration system with the attendant problems of vibration and servicing, or by employing a coolant such as liquid nitrogen. The latter approach suffers from the disadvantage of employing an expendable material, which has obvious disadvantages in an aerospace environment where long life is desired.

A hydride chemical absorption refrigeration system is described in *Design, Life Testing And Future Designs Of Cryogenic Hydride Refrigeration Systems,* J. A. Jones and P. M. Golben, Cryogenics 1985, Vol. 25 April. The system described in this article includes a liquid nitrogen source for providing pre-cooling of high pressure gas which is to be provided to a Joule-Thomson valve for expansion and further cooling. The article also mentions that chemical absorption using nitrogen or oxygen might be feasible for the upper stage of refrigeration.

A cryogenic adsorption refrigerator employing a Joule-Thomson valve is disclosed in U.S. Pat. No. 4,366,680 to Tward. The system disclosed in this patent employs a gaseous refrigerant which is connected by means of heat switches to a thermal load in order to provide the desired cooling. U.S. Pat. No. 4,346,563 to Hood discloses a cryogenic refrigeration system employing a mechanical compressor for compressing helium gas, which gas is subsequently pre-cooled and then cooled by expansion to partially liquefy the helium. Gaseous helium is drawn off from the liquid bath and recycled through heat exchangers back to the compressor. A cryogenic adsorption refrigeration system is described in U.S. Pat. No. 4,183,227 to Bouvin et al. A cryogenic liquid absorption system is disclosed in U.S. Pat. No. 3,854,301 to Cytryn.

SUMMARY OF THE INVENTION

The present invention is directed to a cryogenic chemisorption refrigeration system which may be used as the upper stage of a hydride refrigeration or which may be used independently to provide cooling in the temperature range of approximately 55°–100° K. The system includes at least two containers for containing a material which reversibly chemically reacts with oxygen to absorb oxygen at relatively low temperatures and pressures and release oxygen at high pressure when heated. The containers are alternately heated and cooled to provide a continuous source of high pressure, high temperature oxygen. This oxygen is then subjected to pre-cooling and passed through a Joule Thomson expansion valve to decrease the pressure of the oxygen and cause it to partially liquefy. A collection vessel is provided for the liquid oxygen. The liquid oxygen is used for cooling such as for the cooling of an infrared sensor. The oxygen will then boil and be returned to the containers for chemical absorption onto cooled absorbent material.

The present invention takes advantage of substantial research in which it has been determined that oxygen will reversibly react with several materials in temperature and pressure ranges which renders it suitable for use in a cryogenic refrigeration system. Specifically, it has been determined that oxygen will chemically absorb to several materials at a temperature in excess of 0° C. (273° K.) at pressures less than five atmospheres, and will be rejected at a temperature of less than about 700° C. (973° K.) at a pressure of 10–100 atm. Previously, it had been thought that oxygen reacted in an irreversible manner, i.e., once it combined with an element or compound the reaction could not be reversed to release gaseous oxygen. However, research has indicated that oxygen will indeed react in a reversible fashion with certain materials and will do so at temperatures and pressures which make it practical for incorporation into a cryogenic refrigeration system.

BRIEF DESCRIPTION THE DRAWING

The invention will be described with reference to the accompanying drawing, wherein:

FIG. 1 is a schematic diagram of a system according to the present invention.

DESCRIPTION OF THE PREFERRED EMBODIMENT

Figure 1:
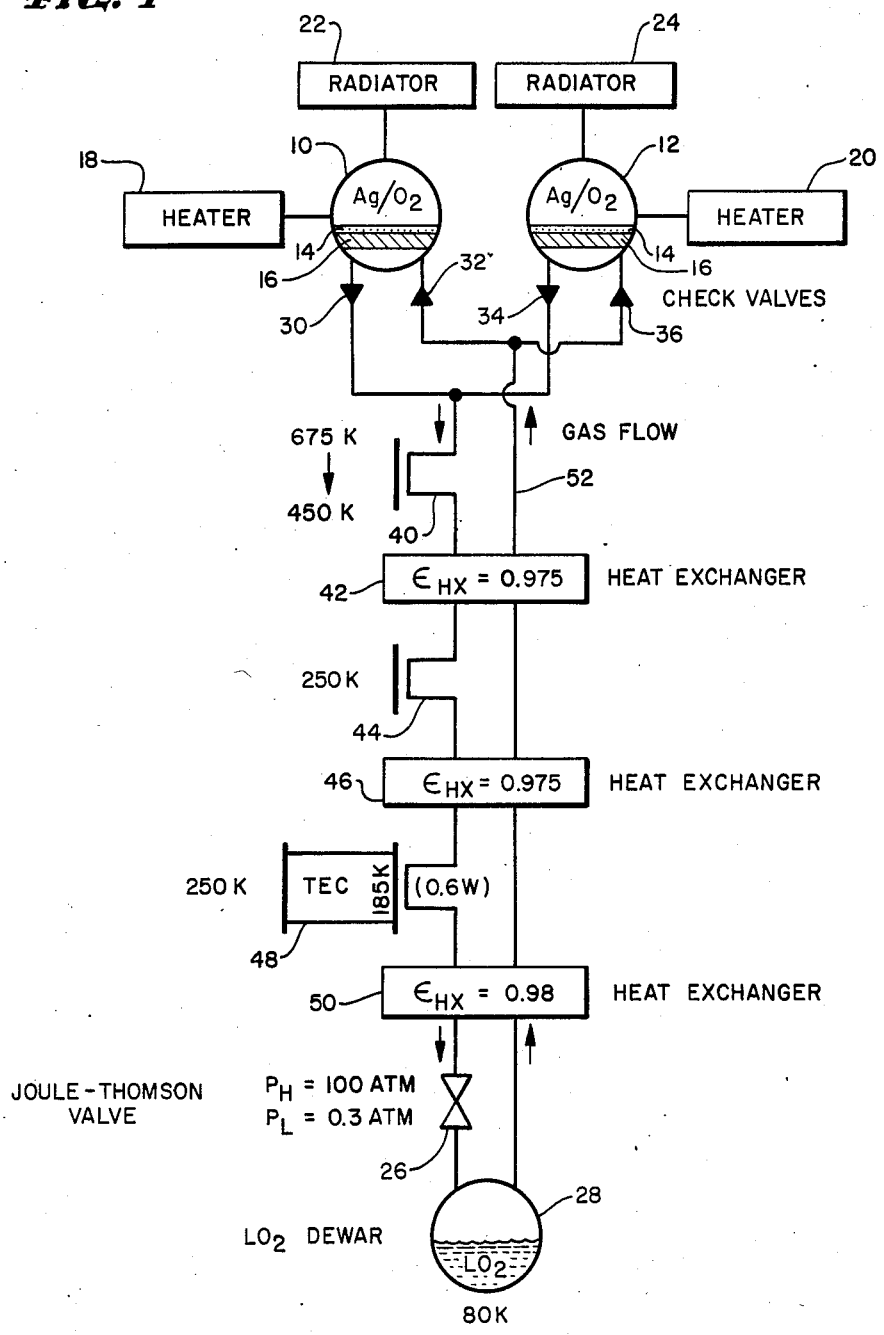

The following description is of the best presently contemplated mode of carrying out the invention. This description is made for the purpose of illustrating the general principles of the invention and is not to be taken in a limiting sense. The scope of the invention is best determined by reference to the appended claims.

Referring to FIG. 1, a refrigeration system according to the present invention includes first and second containers 10 and 12 made of a high melting point material, for example, titanium. The containers 10 and 12 function together to form a compressor to provide high pressure oxygen gas. Each container includes a high surface area substrate material 14 such as zeolite coated with a very thin layer 16 of material which will chemically absorb and desorb oxygen. Preferably, the layer of absorbant material is of unimolecular thickness to minimize weight and maximize efficiency.

The requireient for the absorbent material 16 is that it be a solid which chemically absorbs oxygen at low pressures at approximately 0° C. (273° K.) or above, and secondly, when the material is heated, gas must be liberated or desorbed at higher pressures from the solid. This fully reversible wear-free chemical reaction cycle is termed a chemisorption compressor cryogenic refrigeration cycle. For practical applications, the cycle must be fully reversible and capable of continuous operation for a minimum period of ten years. It is preferable that the full cycle occur in less than one hour to minimize mass of the material Thorough studies were made of all commercially available gases with boiling points between 60° K. and 100° K., including oxygen, nitrogen, carbon monoxide, fluorene and argon to determine if any of them had suitable characteristics for a chemisorption refrigeration system. It has been generally accepted that reactions with these gases are irreversible, i e., once the gas has reacted to combine with another material it cannot be liberated from the material. Indeed, studies by the inventor have indicated that the vast majority of reactions with these gases are irreversible. However, it has been determined that oxygen has relatively efficient and reversible chemisorption in the temperature and pressure range of interest when combined with several different materials. Suitable material combinations with oxygen include:

(a) $K_2O_2$ (potassium oxide) which reacts to form $K_2O_3$
(b) Ag (silver metal) which reacts to form $Ag_2O$
(c) SrO (strontium oxide) which reacts to form $SrO_2$
(d) PbO (lead oxide) which reacts to form $PbO_2$
(e) $Li_2O$ (lithium oxide) which reacts to form $Li_2O_2$ In the system shown in FIG. 1, silver (Ag) is indicated as being the material contained in the containers 10 and 12. A heater 18 is provided to heat the material in the container 10, and a heater 20 is provided to heat the material in the container 12. Heat may be provided by electric heat, solar heat, waste heat or by other means. In order to cool the containers after heating, radiators 22 and 24 are provided.

The refrigeration system of the invention operates so that as one of the containers 10 and 12 is being heated the other container is being cooled. Upon cooling of the material 16 to approximately room temperature (300° K.), significant amounts of oxygen are chemically absorbed at low pressure (1 atm or below). When heated, the oxygen is liberated at a higher pressure (100 atm or above) and temperature (typically 400°–800° K.). The heated gas is then pre-cooled to about room temperature and passes through a Joule-Thomson expansion valve 26. The expansion of the oxygen results in cooling which partially liquefies the gas at cryogenic temperature (90° K. for 1 atm pressure or 80° K. for 0.3 atm pressure). The liquid oxygen is collected in a vessel 28, which is in turn coupled to an external infrared sensor/detector system or other system requiring cooling. Heat from the system being cooled passes internally causing the oxygen to boil from the cryogenic liquid state. The cold, low pressure evaporated oxygen gas then passes back to the containers 10 and 12 where it is reabsorbed by the cooled material in one of the containers.

Details of the refrigeration cycle will now be described. Initially, it is assumed that the material in the container 10 is being heated and the material in the container 12 being cooled. A check valve 30 allows high pressure heated oxygen to escape from the container 10, where it is pre-cooled from, e.g., approximately 675° K. to 450° K. by means of a first radiator 40. The pre-coole-d gas then flows through a counterflow heat exchanger 42 where it is cooled to about 255° K. Additional pre-cooling by a radiator 44 lowers the temperature to 250° K. before the gas enters a second heat exchanger 46.

A small amount of additional heat is rejected to a thermoelectric cooler 48 having a cold junction maintained at 185° K. and a hot side at 250° K. The thermoelectric cooler helps lower the oxygen temperature to improve overall cooling performance. The oxygen is then passed through a third heat exchanger 50 and the Joule-Thomson expansion valve 26. When the oxygen expands to a pressure of just above 0.3 atm, it partially liquefies and produces cooling at 80° K. Lower pressures result in lower temperatures, but heat exchanger efficiency becomes greatly diminished.

External heat from a cryogenic sensor or other system being cooled passes inward to boil the liquid oxygen in the vessel 28, and the resulting cold, low pressure vapor travels back through the counterflow heat exchangers 50, 46 and 42 via conduit 52, thus pre-cooling the entering high pressure oxygen gas passing in the opposite direction through each heat exchanger. The gas then passes through a check valve 36 and is reabsorbed onto the cool 450° K. (177° C.) silver in the container 12.

Once the desorbing and reabsorbing cycle is completed, the heating and cooling operation on the containers 10 and 12 is reversed so that the material in the container 12 is heated and the material in the container 10 is cooled. As a result, high pressure gas will pass through a check valve 34 to exit the container 12 and low pressure gas will enter the container 10 via a check valve 32. By alternately heating and cooling the material in each of the containers 10 and 12, a continuous source of high temperature, high pressure oxygen can be provided.

It has been calculated that the above-described system requires about 78 watts of heat to the silver sorbents and about 12 watts of heat to the thermoelectric cooler for the generation of 1 watt of cooling at 80° K. Although this is generally not as efficient as some of the more efficient mechanical systems (with total efficiency as high as 40 W/W) the waste heat from the present system can be used to power a lower temperature hydride or other refrigeration system. Heating of the containers 10 and 12 can be supplied by efficient solar concentrators or by a radioactive power source waste heat.

Thus, the present invention provides relatively efficient cooling in the range of 60°–100° K., with the system being usable by itself or as an upper stage to provide pre-cooling for a hydride refrigeration system. The system provides vibration-free, long life operation by employing reversible chemical reactions of oxygen to obtain a continuous source of high pessure, high temperature oxygen.

I claim:

1. A cryogenic refrigeration system, comprising:

first and second containers;

an absorbent material located in each container which reversibly chemically reacts with oxygen, wherein in a first reaction oxygen is chemically absorbed by the material and in a second reaction previously absorbed oxygen is desorbed from the material at a relatively high pressure, wherein the first reaction occurs at a temperature below the second reaction;

control means for causing the first and second reactions to alternately occur in each container so that when the first reaction is occurring in one container the second reaction is occurring in the other container, thereby to provide a continuous supply of high pressure oxygen;

an expansion valve for receiving high pressure oxygen from the containers and partially liquefying it;

a vessel for receiving oxygen from the expansion valve; and a conduit coupling the vessel to the containers, wherein liquid oxygen in the vessel is boiled to provide gaseous oxygen to the containers.

2. A system as in claim 1 wherein the control means includes heating means for heating the material in each container.

3. A system as in claim 2 wherein the control means includes radiator means for cooling the material in each container.

4. A system as in claim 3 wherein the heating means operates to heat the absorbent material to between 400°–800° K. and the radiator means operates to cool the absorbent material to a temperature above about 270° K.

5. A system as in claim 4 wherein the absorbent material is silver and wherein the heating means heats the silver to about 675° K. and the radiator means cools the silver to about 450° K.

6. A system as in claim 1 wherein the absorbent material in each container is selected from the group consisting of silver, potassium oxide, strontium oxide, lead oxide and lithium oxide.

7. A system as in claim 6 including a substrate located in each container, wherein a thin layer of the absorbent material covers the substrate.

8. A system as in claim 7 wherein the substrate is zeolite.

9. A system as in claim 2 wherein the heating means operates to heat the absorbent material to between 400°–800° K.

10. A system as in claim 9 including pre-cooling means for cooling the high pressure oxygen prior to delivery to the expansion valve.

11. A system as in claim 10 wherein the pre-cooling means includes at least one counterflow heat exchanger coupled to the conduit for transferring heat from the high pressure oxygen to oxygen in the conduit.

12. A system as in claim 11 wherein the pre-cooling means includes at least one heat radiator.

13. A system as in claim 12 wherein the pre-cooling means includes a thermoelectric cooler.

14. A cryogenic refrigerator system comprising:

first and second containers;

an absorbent material located in each container which reversibly chemically reacts with oxygen, wherein in a first reaction oxygen is chemically absorbed by the material at a temperature of at least about 270° K. and a pressure of less than about 5 atm and wherein in a second reaction oxygen is chemically desorbed from the material at a temperature above about 400° K. and a pressure of between about 10 atm and 100 atm;

control means for alternately heating and cooling the material in each container so that as the material in one container is being heated the material in the other container is being cooled thereby providing a continuous supply of high pressure oxygen;

pre-cooling means for receiving high pressure oxygen from the containers and cooling the oxygen;

a Joule-Thomson expansion valve for receiving oxygen from the pre-cooling means and reducing the pressure and temperature thereof to provide liquid oxygen;

a vessel for receiving oxygen from the expansion valve; and a conduit for providing gaseous oxygen from the vessel to the containers.

15. A system as in claim 14 wherein the pre-cooling means includes a first radiator for receiving oxygen from the container, a first counterflow heat exchanger for receiving oxygen from the first radiator and transferring heat to oxygen in the conduit, a second radiator for receiving oxygen from the first heat exchanger, a second counterflow heat exchanger for receiving oxygen from the second radiator and transferring heat to oxygen in the conduit, a thermoelectric cooler for receiving oxygen from the second heat exchanger, and a third counterflow heat exchanger for receiving oxygen from the thermoelectric cooler and transferring heat to the oxygen in the conduit, oxygen from the third heat exchanger being provided to the expansion valve.

* * * * *